US008194894B2

(12) United States Patent
Burton et al.

(10) Patent No.: US 8,194,894 B2
(45) Date of Patent: Jun. 5, 2012

(54) ACOUSTIC DEVICE

(75) Inventors: Paul Burton, Cambridgeshire (GB); Matthew Dore, Cambridgeshire (GB); Neil Firth, Cambridgeshire (GB)

(73) Assignee: New Transducers Limited, Cambridgeshire (GB)

( * ) Notice: Subject to any disclaimer, the term of this patent is extended or adjusted under 35 U.S.C. 154(b) by 874 days.

(21) Appl. No.: 11/920,929

(22) PCT Filed: May 22, 2006

(86) PCT No.: PCT/GB2006/001872

§ 371 (c)(1),
(2), (4) Date: Nov. 13, 2008

(87) PCT Pub. No.: WO2006/125967

PCT Pub. Date: Nov. 30, 2006

(65) Prior Publication Data

US 2009/0129613 A1 May 21, 2009

Related U.S. Application Data

(60) Provisional application No. 60/684,562, filed on May 26, 2005.

(30) Foreign Application Priority Data

May 24, 2005 (GB) ..... 0510484.9

(51) Int. Cl.
*H04R 25/00* (2006.01)

(52) U.S. Cl. ..... 381/152; 381/190; 381/337; 381/431

(58) Field of Classification Search ..... 381/152, 381/190, 337, 431
See application file for complete search history.

(56) References Cited

U.S. PATENT DOCUMENTS

| | | | | |
|---|---|---|---|---|
| 5,108,338 | A | 4/1992 | Margolis | |
| 6,195,440 | B1 | 2/2001 | Warnaka et al. | |
| 6,411,719 | B1 * | 6/2002 | Moster et al. | 381/345 |
| 7,123,734 | B2 * | 10/2006 | Voth et al. | 381/334 |
| 2003/0053643 | A1 | 3/2003 | Bank et al. | |
| 2005/0069157 | A1 | 3/2005 | Lu | |

FOREIGN PATENT DOCUMENTS

| | | | |
|---|---|---|---|
| CN | 1529840 | A | 9/2004 |
| DE | 3239597 | | 10/1982 |
| GB | 2219171 | A | 11/1989 |
| GB | 2247765 | A | 3/1992 |
| GB | 319429 | A | 5/1998 |
| WO | WO 97/09842 | A2 | 3/1997 |
| WO | WO 01/54450 | A2 | 1/2001 |
| WO | WO 03/009219 | A2 | 1/2003 |

* cited by examiner

*Primary Examiner* — Richard A. Booth
(74) *Attorney, Agent, or Firm* — Roylance, Abrams, Berdo & Goodman, L.L.P.; Alan I. Cantor

(57) ABSTRACT

An assembly (38) comprises a vibration transducer (50) coupled to a substrate (58) which incorporates a circuit (62) electrically connected to the transducer (50). The substrate (58) is adapted to be coupled to a bending wave member (30) for converting actuator vibration into acoustic radiation or vice versa and has sufficient flexibility to allow bending wave coupling between the substrate (58) and the member (30).

26 Claims, 7 Drawing Sheets

ACOUSTIC DEVICE

TECHNICAL FIELD

The present invention relates to acoustic devices, particularly but not exclusively those utilising bending inertial vibration transducers, e.g. an inertial piezoelectric vibration transducer.

BACKGROUND ART

Such bending inertial vibration transducers are discussed in WO01/54450 and may employ a plate-like piezoelectric member that resonates in bending. A mass may be provided on the piezoelectric member. Coupling means, typically a stub, are provided for mounting the transducer to a site to which force is to be applied from or to the member. The member is free to bend and so generate a force via the inertia associated with accelerating and decelerating its own mass during vibration. The bending of the member can either be in response to an electrical signal, in which case the transducer acts as a vibration exciter, or can generate an electrical signal, in which case the transducer acts as a vibration sensor.

WO03/009219, also incorporated by reference, discloses the use of a greetings or similar card in the form of a folded member having a front leaf and a rear leaf. A bending inertial vibration transducer of the kind disclosed in WO01/54450 is attached to one of the leaves by way of a small stub in order to vibrate the leaf. The leaf is configured as a bending wave member for converting this vibration into acoustic radiation, as discussed e.g. in WO97/09842. The transducer is driven by a signal generator/amplifier/battery unit, which is actuated by a switch concealed in the fold of the card so as to activate the signal generator when the card is opened. As is known, such bending wave members may also act as microphones, converting acoustic radiation into vibration which can then be converted into an electrical signal by a transducer.

DISCLOSURE OF INVENTION

According to the invention, there is provided an assembly comprising a vibration transducer coupled to a substrate, the substrate incorporating a circuit electrically connected to the transducer, wherein the substrate is adapted to be coupled to a bending wave member for converting actuator vibration into acoustic radiation or vice versa and has sufficient flexibility to allow bending wave coupling between the substrate and the member.

Such an assembly simplifies the manufacture of a bending wave acoustic device of the kind known e.g. from the aforementioned WO03/009219 by integrating a transducer and its associated electronic circuitry into a single assembly. The flexibility of the substrate ensures that when the assembly is coupled to a bending wave member, there is also bending wave coupling between the assembly and the bending wave member. This in turn facilitates more efficient conversion of actuator vibration into acoustic vibration (or vice versa) than would be the case if the substrate were rigid.

Advantageously, the substrate is configured to present to the vibration transducer a mechanical impedance that lies between that of the vibration transducer and that of the bending wave member. The mechanical impedance of the vibration transducer will typically but not necessarily be higher that that of the bending wave member. Such an arrangement may improve matching between the transducer and the bending wave member and thereby improve the efficiency of power transfer.

In the context of the present document, the term 'transducer' is used to denote an electromagnetic device that can convert electrical energy to vibratory motion, displacement or force as well as converting vibratory motion, displacement or force to electrical energy. It is to be distinguished from a loudspeaker which converts electrical energy to sound pressure.

The Young's Modulus of the substrate may lie in the range 1 to 16 GPa, in particular in the range 3 to 14 GPa. The substrate may be so flexible as to be non-self-supporting.

The vibration transducer may be a piezoelectric bending transducer, in particular an inertial piezoelectric bending vibration transducer. The vibration transducer may comprise a resonant element having a frequency distribution of modes in the operative frequency range of the vibration transducer. The parameters of the resonant element may be such as to enhance the distribution of modes in the element in the operative frequency range, as described e.g. in WO01/54450, incorporated herein by reference. The transducer may be plate-like and may be in the shape of a beam, i.e. an elongate rectangle. The transducer may be a bi-morph, a bi-morph with a central vane or substrate or a uni-morph.

The substrate may be substantially planar and may comprise a recess to accommodate the vibration movement of the transducer, thereby allowing a slimmer assembly overall. The recess may be defined by an aperture extending between opposite surfaces of the substrate.

The substrate may comprise two recesses separated by a bridge portion, the vibration transducer being attached to the bridge portion. The transducer may also have means for transmitting vibration via a path other than through said substrate. The means may comprise a stub protruding from the opposite surface of the transducer to that attached to the substrate. The substrate may be a printed circuit board and may further include one or more of a power supply, control circuits and a solid state data storage device such as a sound chip or an MP3 player or the like.

The invention also provides an acoustic device comprising such an assembly and a bending wave member coupled thereto for converting actuator vibration into acoustic radiation or vice versa. The substrate may have a first face coupled to the bending wave member and a second face coupled to the transducer.

The bending wave member may be panel of low mechanical impedance such as a panel of a greetings or the like card. Alternatively, the bending wave member may be a component of other applications made from materials of low mechanical impedance such as balloons (or other inflatable objects), printed matter such as books, guides, timetables or maps, packaging and skinned laminate cards (as used e.g. for trading, credit, identity and smart cards).

In the latter case, the bending wave member may comprise two sheets joined at their edges, the assembly being located between the two sheets. The substrate may be coupled to one of said two sheets and means for transmitting vibration via a path other than through said substrate may be coupled to the other of said two sheets. The card may also comprise means for spacing at least the middle regions of the two sheets.

One example of packaging may include a shape such as a promotional figure, defined by perforated edges which allow the shape to be removed. The shape may be folded into a stand-up novelty item that will also produce sound independently from the packaging. However, while it is still a part of the packaging, the perforated edge is sufficiently stiff to allow coupling of bending wave vibrations into the rest of the structure. An alternative packaging may comprise a transducer assembly in conjunction with an olfactory sensor and a motion sensor to generate audible warnings if food in the packaging has gone off and the packaging is picked up to be opened.

The bending wave member may be a panel-form member. The acoustic device may be a resonant bending wave loudspeaker wherein the transducer excites resonant bending wave modes in the bending wave member. Such a loudspeaker is described in International Patent Application WO97/09842 which is incorporated by reference and other patent applications and publications, and may be referred to as a distributed mode loudspeaker.

BRIEF DESCRIPTION OF THE DRAWINGS

The invention will now be described by way of example by reference to the following diagrams, of which.

MODES FOR CARRYING OUT THE INVENTION

Figure 1:
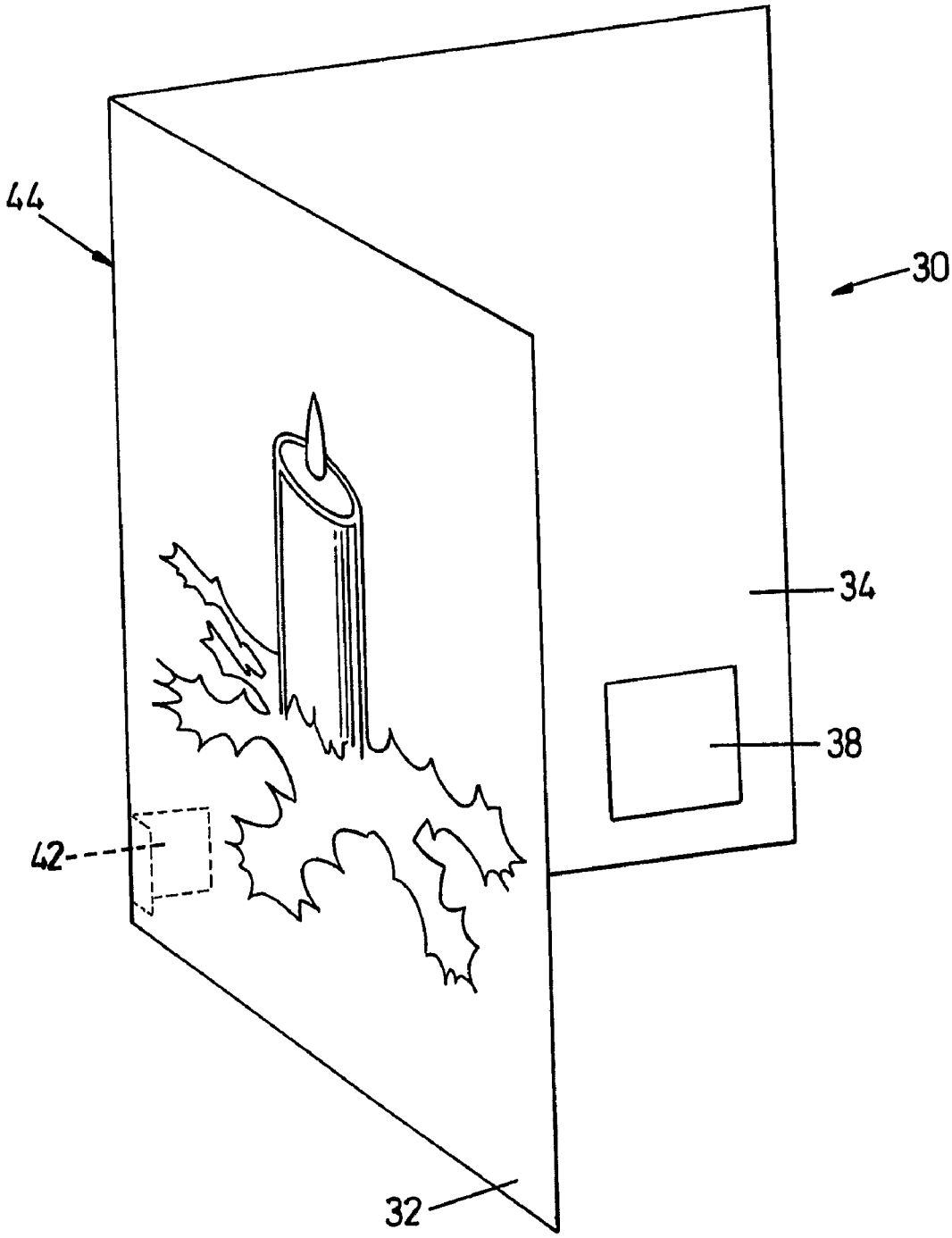
FIG. 1 is a perspective view of a first embodiment of the invention.

FIG. 1 is a perspective view of a greetings card 30 of the kind disclosed in the aforementioned WO03/009219 and incorporating the present invention. The card is in the form of a folded member having a front leaf 32 and a rear leaf 34. An assembly 38 in accordance with the present invention is attached to the rear leaf to cause it to resonate to produce an acoustic output. The position of the assembly may be at a preferred location as defined in the aforementioned WO97/09842. In addition to an amplifier, the assembly may include a battery and a signal generator which is actuated by a switch 42 concealed in the fold 44 of the card so as to activate the signal generator when the card is opened.

Figure 2A:
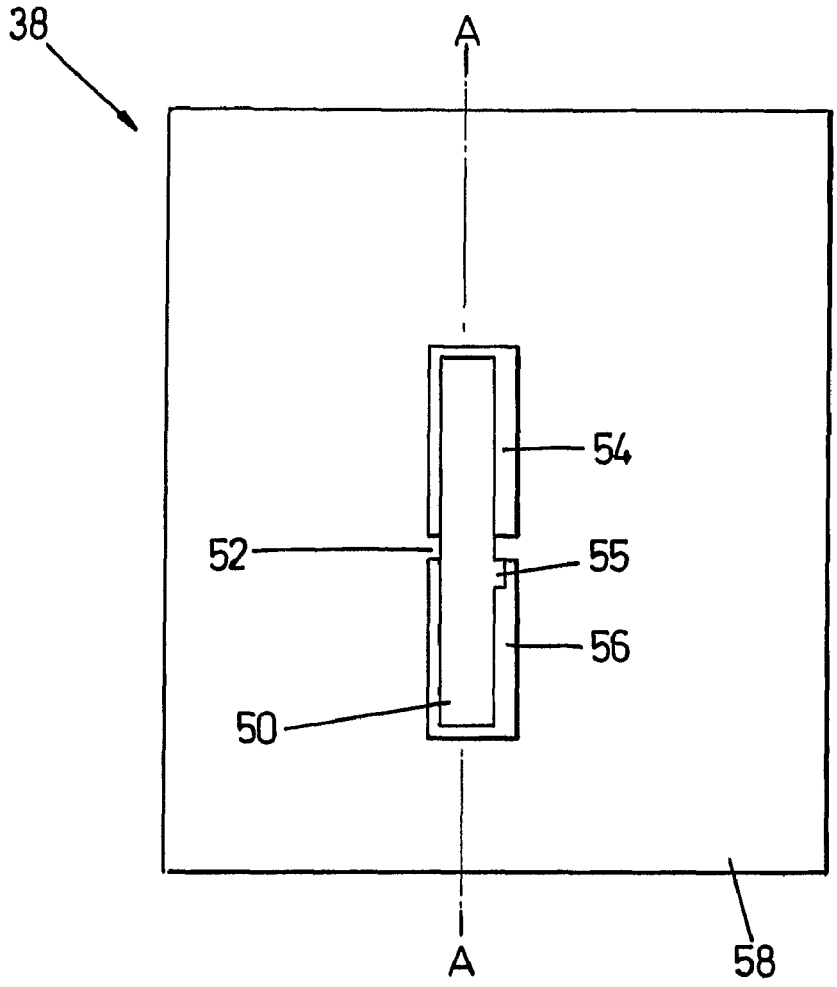
FIG. 2A is a plan view of the transducer assembly of the embodiment of FIG. 1.

FIG. 2A is an enlarged plan view of the assembly 38 of FIG. 1. A beam-like piezoelectric bending inertial vibration transducer 50 is mounted and attached, e.g. by a layer of adhesive or by double-sided tape to a bridge portion 52 defined between two recesses 54,56 in a substantially planar substrate, in this case a printed circuit board 58. The transducer is formed with an extension which provides an electrical connector 55.

Figure 2B:
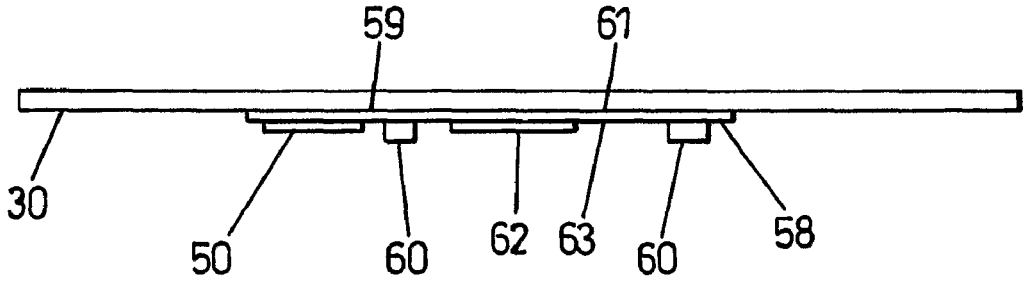
FIG. 2B is a sectional view taken along line AA of FIG. 2A.

FIG. 2B is a sectional view taken along line A-A of FIG. 2A. One side or face 59 of the printed circuit board 58 is adapted to be coupled to a surface of the bending wave member (card 30) for converting actuator vibration into acoustic radiation or vice versa. Such coupling may be achieved, for example, by adhesive bonding or double-sided adhesive tape as shown at 61. On the opposite side or face 63 of substrate 58 is mounted the transducer 50 and circuit 62 electrically coupled thereto, e.g. via connector 55.

A second sheet (as later illustrated in FIG. 3) may be attached to cover the transducer and substrate. To prevent the transducer 50 from driving or buzzing such a sheet, spacers 60 may be provided on the substrate, e.g. adjacent either recess 54, 56. These spacers may be constructed from two layers of the printed circuit board material and may be mounted using double-sided tape.

Figure 2C:
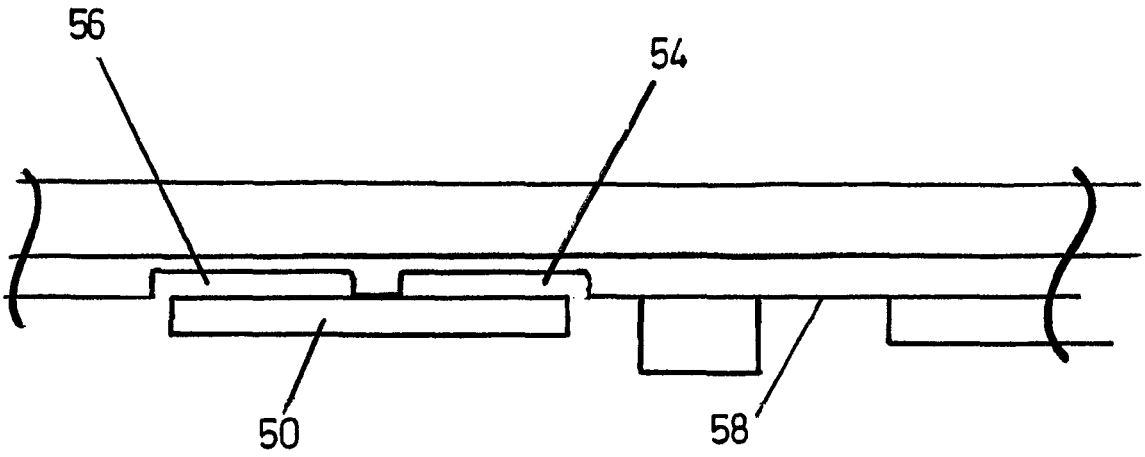
FIG. 2C is a sectional view of a second embodiment of the invention.

Although in the example shown the recesses are provided by apertures 54,56 extending between opposite faces of the substrate, the recesses need not extend through the substrate, i.e. they may be 'blind' as illustrated in the sectional view of FIG. 2C.

Figure 2D:
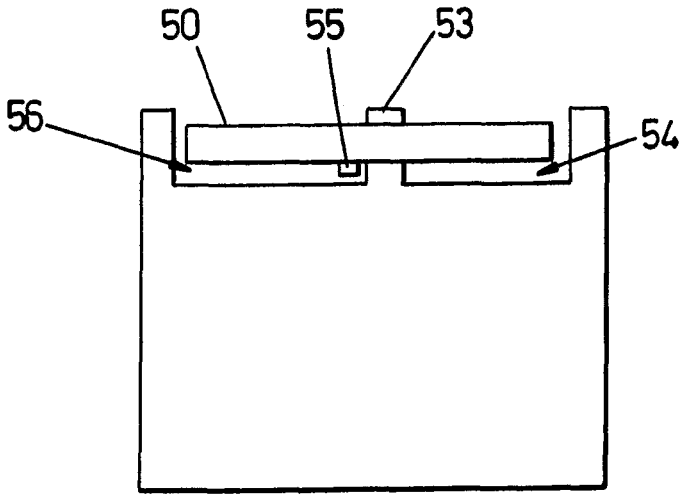
FIG. 2D is a plan view of a third embodiment of the invention.

In the alternative embodiment of FIG. 2D, the two apertures 54,56 are located adjacent the edge of the printed circuit board such that they are open to one side resulting in a bridge portion 53 that is only supported on one side.

Figure 2E:
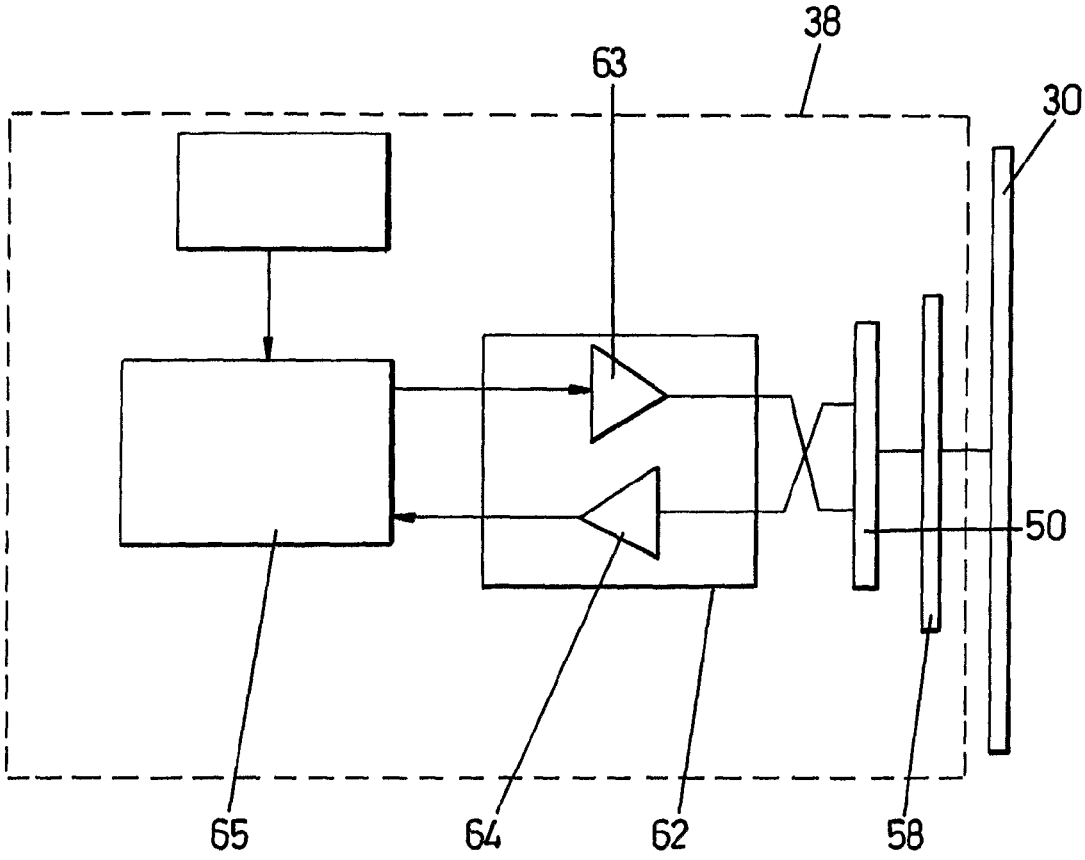
FIG. 2E is a block diagram illustrating the functional interrelationship of elements of the invention.

FIG. 2E is a block diagram showing the interrelationship of the elements shown in FIGS. 2*a* and 2*b*. As indicated by the dashed line, assembly 38 comprises a substrate 58 to which is coupled a vibration transducer 50 and which incorporates a circuit 62 electrically connected to the transducer 50. In the example shown, the circuit includes both an output amplifier 63 and an input amplifier 64.

Output amplifier 63 amplifies a signal from a data store 65 so as to drive transducer 50 to excite bending wave diaphragm 30 via substrate 58 and thereby generate acoustic radiation. Where the diaphragm forms part of a greetings card, for example, the acoustic radiation may be in the form of a melody or a spoken greeting.

Input amplifier 64 amplifies an electrical signal generated by transducer 50 when vibrated by the diaphragm 30 which itself has been excited to bending wave vibration by incoming acoustic radiation. This electrical signal is stored in data store 65 with a view to reproducing the acoustic radiation at a later date. Thus, in the example of a greetings card given above, the person sending the card may speak a message into the card (acting as a microphone), which message is then reproduced by the card (acting as a loudspeaker) when the card is subsequently opened by the recipient. The circuitry may further comprise, inter alia, a signal receiver, a digital to analogue converter, an analogue to digital converter, a sensor, a haptics generator, a light (s), an olfactory generator or an olfactory sensor.

With regard to the properties of the substrate, typical transducers are designed to have an operating output impedance of around 3 to 4 Ns/m. However, the material typically used to make a greetings card 30 has a mechanical impedance less than 1 Ns/m. For efficient power transfer, the output impedance of the transducer 50 should match the mechanical impedance of the load. Accordingly, printed circuit board 58 is configured to increase the mechanical impedance load presented to the transducer to nearer its operating value. This may be achieved e.g. by appropriate choice of substrate material and thickness.

In the example shown, the substrate is made from the grade of printed circuit board known as FR4 having a Young's Modulus of 14 GPa,a thickness of 0.4 mm and a mechanical impedance of 2.5 Ns/m. This increases the overall mechanical impedance load presented to the transducer to around 3.5 Ns/m. Higher Young's Modulus values for the substrate material are possible, although values greater than 16 GPa are typically too close to that of the piezoelectric transducer to provide matching. Lower Young's Modulus values for the substrate material are also possible, although these will not go below the 1 GPa stiffness of the hard card of the kind useable in the aforementioned W003/009219 and are more likely to be equal to or greater than 3 GPa in order to provide matching.

As regards substrate thickness, useful embodiments have thicknesses in the range 100 μm to 2 mm, with thicknesses in the range 150 μm to 1 mm providing even better matching.

FR4 is made of epoxy resin that saturates woven fibreglass. Other materials resistant to compression may also be suitable, including flexible (i.e. non-self-supporting when held horizontally along one edge) printed circuit boards and substrates for printable electronics made from polyamides and other sheet or film polymers and laminates. Such substrates are known, e.g. from "The A to Z of Printed and Disposable Electronics" (www.idtechex.com), "Printed Electronics" (www.printelec.com), and "Review of Flexible Circuit Technology and Its Applications" P McLeod; PRIME Faraday Partnership UK; 2002 (ISBN 1 84402 023-1). Pulp-based card having the necessary properties may also be suitable.

Figure 3C:
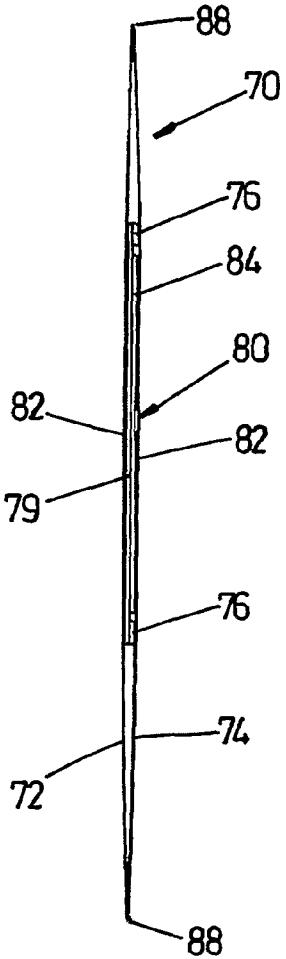
FIGS. 3A, 3B and 3C are a plan view, an exploded sectional view and an assembled sectional view of a fourth embodiment of the invention.
Figure 3B:
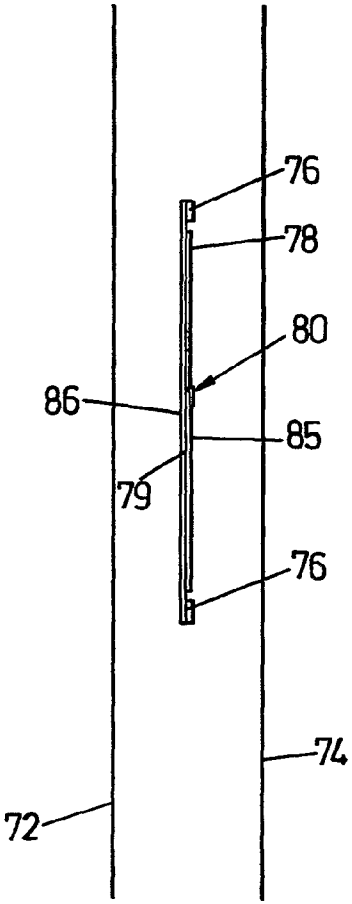
Figure 3A:
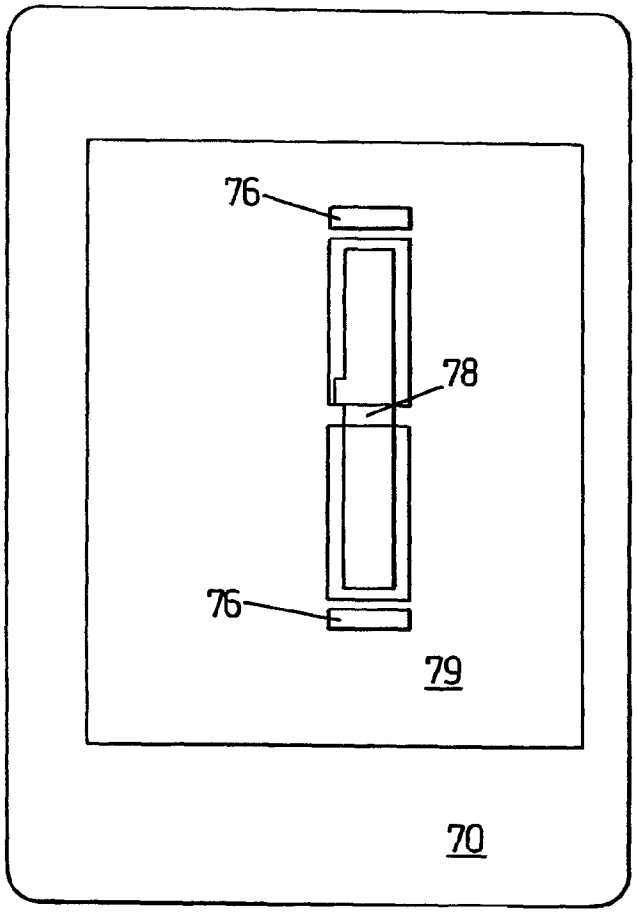

FIG. 3A is a plan view of another embodiment of the invention and FIGS. 3B and 3C exploded and assembled views thereof. A bending wave member 70 is formed from two skins or sheets 72,74 joined at their edges 88 and separated towards their middle regions 82 by spacers 76 to create a gap 84 in which bending inertial vibration transducer 78 is located. The transducer 78 is attached for transmission of vibration to the first skin 72 by a printed circuit board 79 and to the second skin 74 at its mid point 82 by means of a stub 80 protruding from the opposite surface 85 of the transducer 78 to that surface 86 attached to the circuit board 79.

Such an arrangement provides a low profile and is suitable e.g. for novelty trading cards. Moreover, the stub and printed circuit board connection to one of the skins and the stub connection to the other of the skins allows both skins to radiate acoustically as well as increasing the impedance seen by the transducer as compared with a single cardboard skin. The location of the transducer between the two skins also gives added protection to the transducer. The curve of the skins from their edges 88 to their middle regions 90 also increases their stiffness which may also enhance their acoustic performance.

Figure 4A:
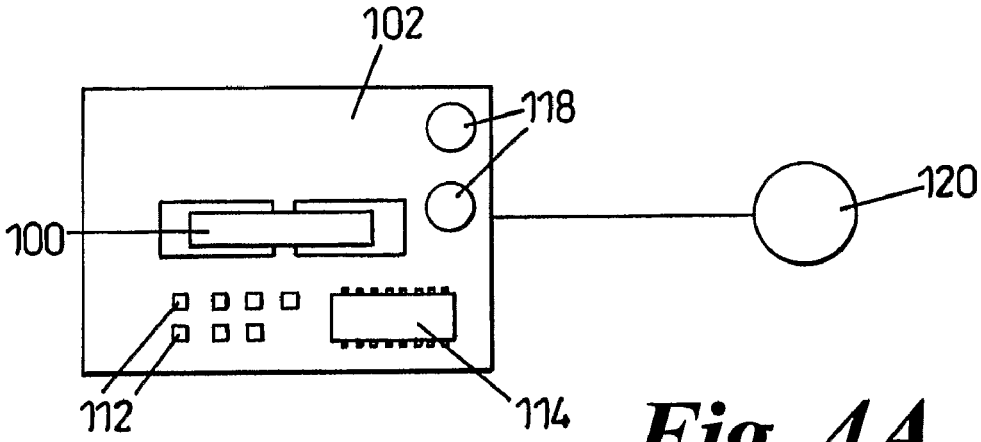
FIGS. 4A to 4D are diagrammatic plan views of transducer assemblies according to four further embodiments of the invention.
Figure 4B:
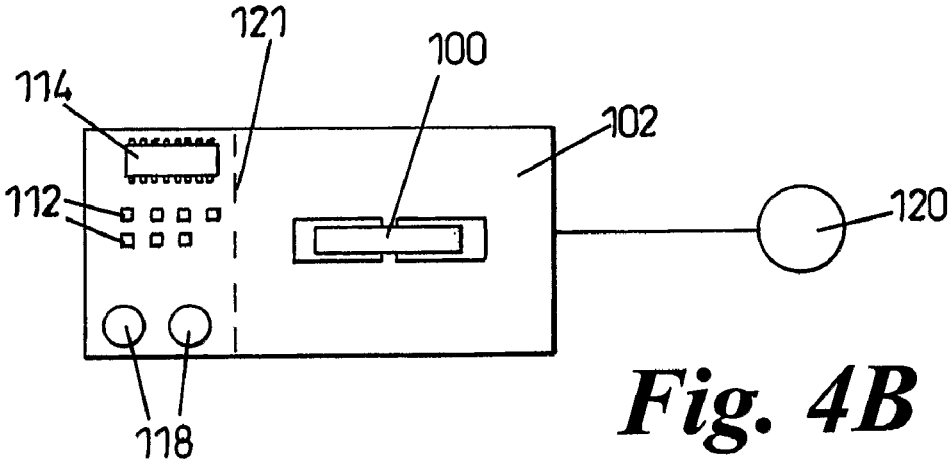

FIGS. 4A and 4B both show embodiments in which the printed circuit board 102 houses all of the components, namely an embedded transducer 100, an amplifier 112, a sound source 114 and button cell batteries 118. A start stop mechanism 120 is connected to the assembly. The interconnections on the printed circuit board are a combination of copper track and wire. In FIG. 4B, the components are arranged to decouple the area of the printed circuit board that contains the electronic components from the transducer whereby the acoustic performance may be improved. Such decoupling is indicated by dashed line 121 and may be achieved e.g. by grooves or holes formed in the substrate.

Figure 4C:
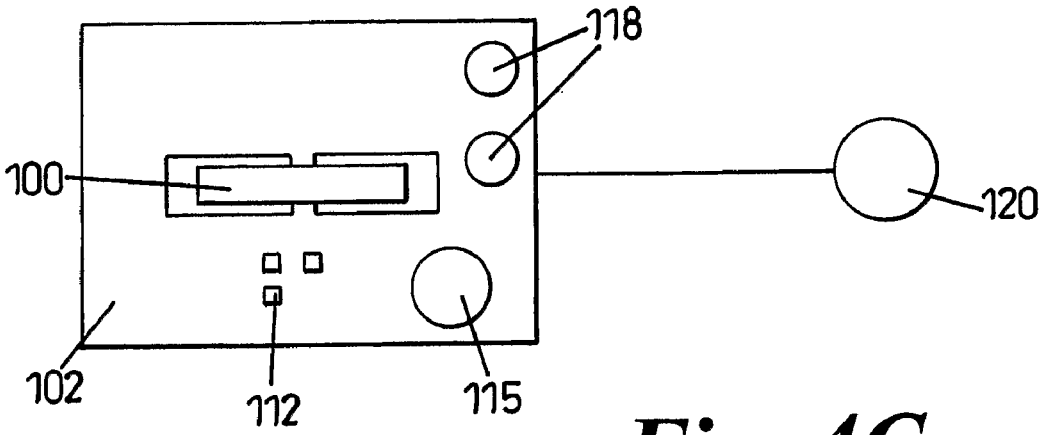
Figure 4D:
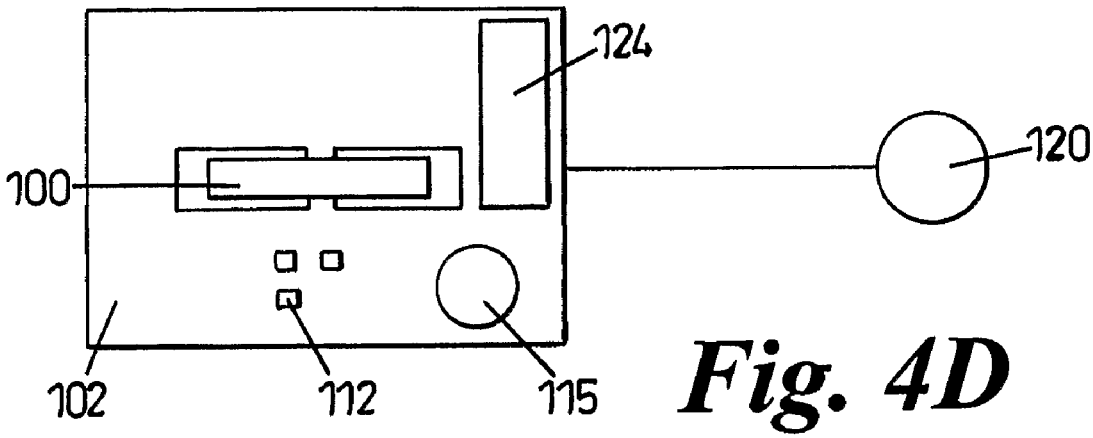

FIG. 4C shows a printed circuit board 102 incorporating an embedded transducer 100, an amplifier 112, a sound source 115 in the form of an ASIC (Application Specific Integrated Circuit) and button cell batteries 118. The integrated circuit is deposited directly on the board and cased under a die. As shown in FIG. 4F, the thickness of the assembly may be further reduced by replacing the button cell batteries with a thin battery 124.

Figure 5:
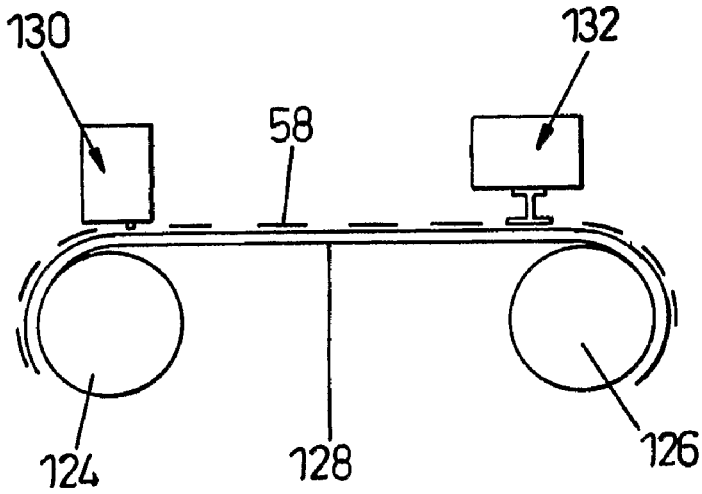
FIG. 5 is a schematic diagram of a manufacturing process for a transducer assembly according to the present invention.

FIG. 5 illustrates how the assembly of the present invention might be manufactured in practice. Individual substrates 58 are conveyed by belt or web 128 supported by rollers 124,126. The electronics, including ASIC, batteries and interconnects are first placed on the substrate (so-called 'printing') on the board at station 130 and the transducer is thereafter embedded on the substrate at station 132. It should be understood that this invention has been described by way of examples only and that a wide variety of modifications can be made without departing from the scope of the invention.

For example, whilst the invention has been described with regard to an inertial piezoelectric bending vibration exciter, it is equally applicable non-inertial piezoelectric bending transducers and to moving coil or moving armature electrodynamic transducers.

The invention claimed is:

1. An assembly comprising a vibration transducer coupled to a substrate, the substrate incorporating a circuit electrically connected to the transducer, wherein the substrate is adapted to be coupled to a bending wave member of low mechanical impedance for converting actuator vibration into acoustic radiation or vice versa and has sufficient flexibility to allow bending wave coupling between the substrate and such a bending wave member of low mechanical impedance and wherein the mechanical impedance of the vibration transducer is higher than that of the bending wave member and the substrate is configured to present to the vibration transducer a mechanical impedance that lies between that of the vibration transducer and that of the bending wave member.

2. An assembly according to claim 1, wherein the substrate has a Young's Modulus value in the range 1 to 16 GPa.

3. An assembly according to claim 2, wherein the substrate has a Young's Modulus value in the range 3 to 14 GPa.

4. An assembly according to claim 1, wherein the substrate is so flexible as to be non-self-supporting.

5. An assembly according to claim 1, wherein the vibration transducer is a piezoelectric bending transducer.

6. An assembly according to claim 5, wherein the vibration transducer is an inertial piezoelectric bending vibration transducer.

7. An assembly according to claim 6, wherein the inertial piezoelectric bending vibration transducer is beam-like.

8. An assembly according to claim 1, wherein the vibration transducer comprises a resonant element having a frequency distribution of modes in the operative frequency range of the vibration transducer.

9. An assembly according to claim 1, wherein the substrate is substantially planar.

10. An assembly according to claim 1, wherein the substrate comprises a recess to accommodate the vibration movement of the transducer.

11. An assembly according to claim 10, wherein the recess is defined by an aperture extending between opposite surfaces of the substrate.

12. An assembly according to claim 10, wherein the substrate comprises two recesses separated by a bridge portion, the vibration transducer being attached to the bridge portion.

13. An assembly according to claim 1, wherein the vibration transducer is configured to transmit vibration via a path other than through said substrate.

14. An assembly according to claim 13, wherein said the transducer comprises a stub protruding from the opposite surface of the transducer to that attached to the substrate.

15. An assembly according to claim 1, wherein the substrate includes one or more of an amplifier, a power supply, control circuits and a solid state data storage device.

16. An assembly according to claim 1, wherein the substrate is a printed circuit board.

17. An acoustic device comprising an assembly and a bending wave member of low mechanical impedance coupled thereto for converting actuator vibration into acoustic radiation or vice versa, the assembly comprising a vibration transducer coupled to a substrate, the substrate incorporating a circuit electrically connected to the transducer, wherein the substrate is coupled to the bending wave member and has sufficient flexibility to allow bending wave coupling between the substrate and the bending wave member, and wherein the mechanical impedance of the vibration transducer is higher than that of the bending wave member and the substrate is configured to present to the vibration transducer a mechanical impedance that lies between that of the vibration transducer and that of the bending wave member.

18. An acoustic device according to claim 17, wherein the substrate has a first face coupled to the bending wave member and a second face coupled to the transducer.

19. An acoustic device according to claim 17, wherein the bending wave member is a panel-form member.

20. Packaging comprising an acoustic device, the acoustic device comprising an assembly and a bending wave member of low mechanical impedance coupled thereto for converting actuator vibration into acoustic radiation or vice versa, the assembly comprising a vibration transducer coupled to a substrate, the substrate incorporating a circuit electrically connected to the transducer, wherein the substrate is coupled to the bending wave member and has sufficient flexibility to allow bending wave coupling between the substrate and the bending wave member, and wherein the mechanical impedance of the vibration transducer is higher than that of the bending wave member and the substrate is configured to present to the vibration transducer a mechanical impedance that lies between that of the vibration transducer and that of the bending wave member.

21. An inflatable device comprising an acoustic device, the acoustic device comprising an assembly and a bending wave member of low mechanical impedance coupled thereto for converting actuator vibration into acoustic radiation or vice versa, the assembly comprising a vibration transducer coupled to a substrate, the substrate incorporating a circuit electrically connected to the transducer, wherein the substrate is coupled to the bending wave member and has sufficient flexibility to allow bending wave coupling between the substrate and the bending wave member, and wherein the mechanical impedance of the vibration transducer is higher than that of the bending wave member and the substrate is configured to present to the vibration transducer a mechanical impedance that lies between that of the vibration transducer and that of the bending wave member.

22. A greetings card comprising an acoustic device, the acoustic device comprising an assembly and a bending wave member of low mechanical impedance coupled thereto for converting actuator vibration into acoustic radiation or vice versa, the assembly comprising a vibration transducer coupled to a substrate, the substrate incorporating a circuit electrically connected to the transducer, wherein the substrate is coupled to the bending wave member and has sufficient flexibility to allow bending wave coupling between the substrate and the bending wave member, and wherein the mechanical impedance of the vibration transducer is higher than that of the bending wave member and the substrate is configured to present to the vibration transducer a mechanical impedance that lies between that of the vibration transducer and that of the bending wave member.

23. A greetings card according to claim 22, wherein the bending wave member comprises two sheets joined at their edges, the assembly being located between the two sheets.

24. A greetings card according to claim 23 wherein the vibration transducer is configured to transmit vibration via a path other than through said substrate which is coupled to one of said two sheets and said substrate is coupled to the other of said two sheets.

25. A greetings card according to claim 24 and further comprising a spacer for spacing at least the middle regions of the two sheets.

26. A greetings card according to claim 23 and further comprising a spacer for spacing at least the middle regions of the two sheets.

* * * * *